US008794207B2

(12) United States Patent
Shiotani et al.

(10) Patent No.: US 8,794,207 B2
(45) Date of Patent: Aug. 5, 2014

(54) METHOD FOR PROCESSING CYLINDER BLOCK, CYLINDER BLOCK AND THERMAL-SPRAYED CYLINDER BLOCK

(75) Inventors: Eiji Shiotani, Kawasaki (JP); Akira Shimizu, Yokohama (JP); Hidenobu Matsuyama, Yokohama (JP); Daisuke Terada, Yokohama (JP); Yoshito Utsumi, Yokohama (JP); Yoshitsugu Noshi, Yokohama (JP); Hiroshi Hatta, Yokohama (JP); Masami Tashiro, Kanagawa-ken (JP); Shuji Adachi, Tokyo (JP); Hiroaki Mochida, Atsugi (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 0 days.

(21) Appl. No.: 13/576,086

(22) PCT Filed: Mar. 4, 2011

(86) PCT No.: PCT/JP2011/055029

§ 371 (c)(1),
(2), (4) Date: Jul. 30, 2012

(87) PCT Pub. No.: WO2011/111615

PCT Pub. Date: Sep. 15, 2011

(65) Prior Publication Data

US 2012/0304955 A1 Dec. 6, 2012

(30) Foreign Application Priority Data

Mar. 11, 2010 (JP) ..... 2010-054403

(51) Int. Cl.
*F02F 1/00* (2006.01)

(52) U.S. Cl.
USPC ..... 123/193.2; 123/193.1; 29/888.01; 29/888.06

(58) Field of Classification Search
USPC ..... 123/193.2, 193.1, 193.3, 193.5, 193.4; 29/888.01, 888.06, 888.061, 888.074
See application file for complete search history.

(56) References Cited

U.S. PATENT DOCUMENTS

| | | | | |
|---|---|---|---|---|
| 7,851,046 | B2 * | 12/2010 | Nishimura et al. | 428/141 |
| 2006/0048386 | A1 * | 3/2006 | Boehm et al. | 29/888.06 |

(Continued)

FOREIGN PATENT DOCUMENTS

| | | | |
|---|---|---|---|
| CN | 101016613 | A | 8/2007 |
| CN | 100529153 | C | 8/2009 |
| DE | 10 2004 038 174 | A1 | 2/2006 |
| JP | 2007-056793 | A | 3/2007 |
| JP | 2007-211307 | A | 8/2007 |
| KR | 10-2007-0092117 | | 9/2007 |
| RU | 2 156 370 | C1 | 9/2000 |
| RU | 2 376 488 | C2 | 8/2009 |

OTHER PUBLICATIONS

Russian Decision on Grant dated Nov. 11, 20013, (12 pgs.).
Korean Office Action dated Dec. 20, 2013, (5 pgs.).
Chinese Office Action dated Dec. 27, 2013, (6 pgs.).

*Primary Examiner* — Noah Kamen
*Assistant Examiner* — Long T Tran
(74) *Attorney, Agent, or Firm* — Foley & Lardner LLP

(57) ABSTRACT

A method for processing a cylinder block is disclosed, wherein a protrusion protruding toward a crankcase is provided at a crankcase-side edge of a cylinder bore and a sprayed coating is formed on an inner surface of the cylinder bore and an inner surface of the protrusion continuous with the inner surface of the cylinder bore. After forming the sprayed coating, at least part of the protrusion is removed together with the sprayed coating formed on the inner surface of the protrusion. Accordingly, even in the case of removing the edge portion of the cylinder bore on the crankcase side, a sufficient margin to be removed can be ensured while a reduction in size of the cylinder block is achieved.

13 Claims, 3 Drawing Sheets

(56) References Cited

U.S. PATENT DOCUMENTS

2007/0190272 A1 8/2007 Kanai et al.
2007/0212519 A1 9/2007 Nishimura et al.
2008/0245320 A1* 10/2008 Ishikawa ..... 123/41.74
2011/0000085 A1* 1/2011 Kanai et al. ..... 29/888.061
2011/0023777 A1 2/2011 Nishimura et al.

* cited by examiner

METHOD FOR PROCESSING CYLINDER BLOCK, CYLINDER BLOCK AND THERMAL-SPRAYED CYLINDER BLOCK

TECHNICAL FIELD

The present invention relates to a method for processing a cylinder block to form a sprayed coating on an inner surface of a cylinder bore, and a cylinder block provided with a sprayed coating formed thereon and a thermal-sprayed cylinder block.

BACKGROUND ART

In order to decrease fuel consumption and exhaust emissions of internal combustion engines, and reduce size and weight of engines, it is highly desirable to eliminate the use of cylinder liners which are used to line aluminum cylinder blocks. As an alternative, thermal spraying to form sprayed coatings on inner surfaces of cylinder bores is being considered.

In the case of applying thermal spraying to a cylinder bore, a thermal spraying gun for providing a spraying material to a cylinder bore is rotated in the cylinder bore while moving in an axial direction to form a sprayed coating. Then, the surface of the coating on the cylinder bore is subjected to finish polishing such as honing.

In association with such a process, Patent Document 1 describes a process of removing an edge portion of an inner surface of a cylinder bore on a crankcase side, in order to prevent detachment of a sprayed coating especially on the crankcase side. In other words, the inner surface of the cylinder bore is removed including the edge portion of the sprayed coating on the crankcase side after the formation of the sprayed coating in such a manner that the internal diameter of the cylinder bore at the edge portion of the sprayed coating on the crankcase side is increased.

CITATION LIST

Patent Literature

Patent Document 1: Japanese Patent Unexamined Publication No. 2007-211307

SUMMARY OF THE INVENTION

In conventional cylinder blocks, as in the case described above, an inner surface of a cylinder bore at an edge portion of a sprayed coating on a crankcase side is removed in order to prevent detachment of the sprayed coating. However, in the case in which a cylinder block is minimized to reduce weight in order to improve fuel consumption, there is a problem with ensuring a sufficient margin of the inner surface of the cylinder bore to be removed to prevent detachment of the sprayed coating.

The present invention has been made in view of such a conventional problem. It is an object of the present invention to sufficiently ensure a processed margin of an edge portion of a cylinder bore on a crankcase side while achieving miniaturization of a cylinder block when removing the edge portion of the cylinder bore together with a sprayed coating.

A method for processing a cylinder block as a first aspect of the present invention includes: providing a protrusion protruding toward a crankcase at a crankcase-side edge of a cylinder bore and forming a sprayed coating on an inner surface of the cylinder bore and an inner surface of the protrusion continuous with the inner surface of the cylinder bore; and after forming the sprayed coating, removing at least part of the protrusion together with the sprayed coating formed on the inner surface of the protrusion.

A cylinder block as a second aspect of the present invention includes: a cylinder; a protrusion provided at a crankcase-side edge of a cylinder bore of the cylinder and protruding toward a crankcase; and a sprayed coating formed on an inner surface of the cylinder bore and an inner surface of the protrusion continuous with the inner surface of the cylinder bore. At least part of the protrusion is removed together with the sprayed coating formed on the inner surface of the protrusion.

A thermal-sprayed cylinder block as a third aspect of the present invention is a cylinder block provided with a sprayed coating formed on an inner surface of a cylinder bore. The thermal-sprayed cylinder block includes: a cylinder; and a protrusion provided at a crankcase-side edge of the cylinder bore of the cylinder and protruding toward a crankcase. The protrusion has a tip portion that is thinner than a base portion.

DESCRIPTION OF THE EMBODIMENTS

An embodiment of the present invention will be described with reference to the drawings.

Figure 1:
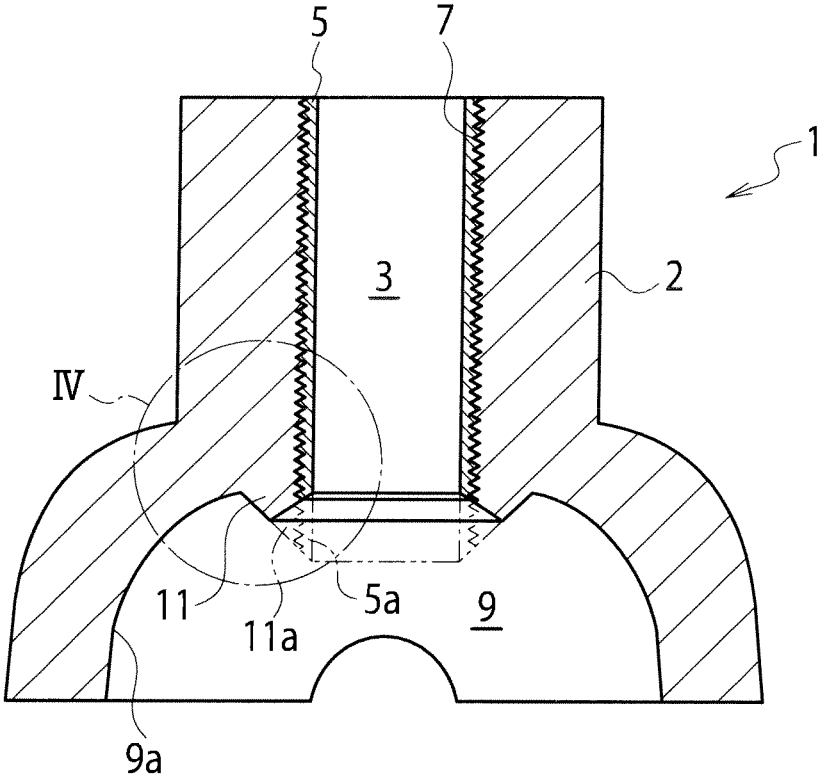
FIG. 1 is a cross-sectional view of a cylinder block according to an embodiment of the present invention.

As shown in FIG. 1, a cylinder block 1 includes a cylinder 2 and a crankcase 9 that are integrally formed. The cylinder block 1 is provided with a sprayed coating 5 which is sprayed on the inner surface of a cylinder bore 3. The cylinder block 1 may be made from cast iron and an aluminum alloy, and the sprayed coating 5 may be composed of an iron-based metal material. A corrugated rough surface 7 is preliminarily formed on the base of the cylinder block 1 on which the sprayed coating 5 is provided. The rough surface 7 contributes to improved adhesion of the sprayed coating 5 to the inner surface of the cylinder bore 3.

In the present embodiment, a protrusion 11 is formed at a crankcase-side edge of the cylinder bore 3 while protruding toward the crankcase 9 in the axial direction of the cylinder bore 3. The protrusion 11 is circumferentially formed around the periphery of the cylinder bore 3. The sprayed coating 5 is continuous around the inner surface of the protrusion 11.

The protrusion 11 is formed in such a manner that a tip portion 11*a* has an approximately triangular shape in cross-section that is provided as a removal margin and is removed by machining after the sprayed coating 5 is formed. The tip portion 11*a* of the protrusion 11 is also provided with a sprayed coating 5*a* that is continuous with the sprayed coating 5 provided on the inner surface of the cylinder bore 3. Here, the tip portion 11*a* is indicated by a two-dot chain line in the figures.

The adhesion of the sprayed coating 5 is particularly poor in an edge portion in the axial direction of the cylinder bore 3 compared to the other areas of the sprayed coating 5. Thus, the tip portion 11*a* of the protrusion 11 is removed together with the sprayed coating 5*a* so as to decrease the area of poor adhesion and increase overall adhesion.

Figure 2:
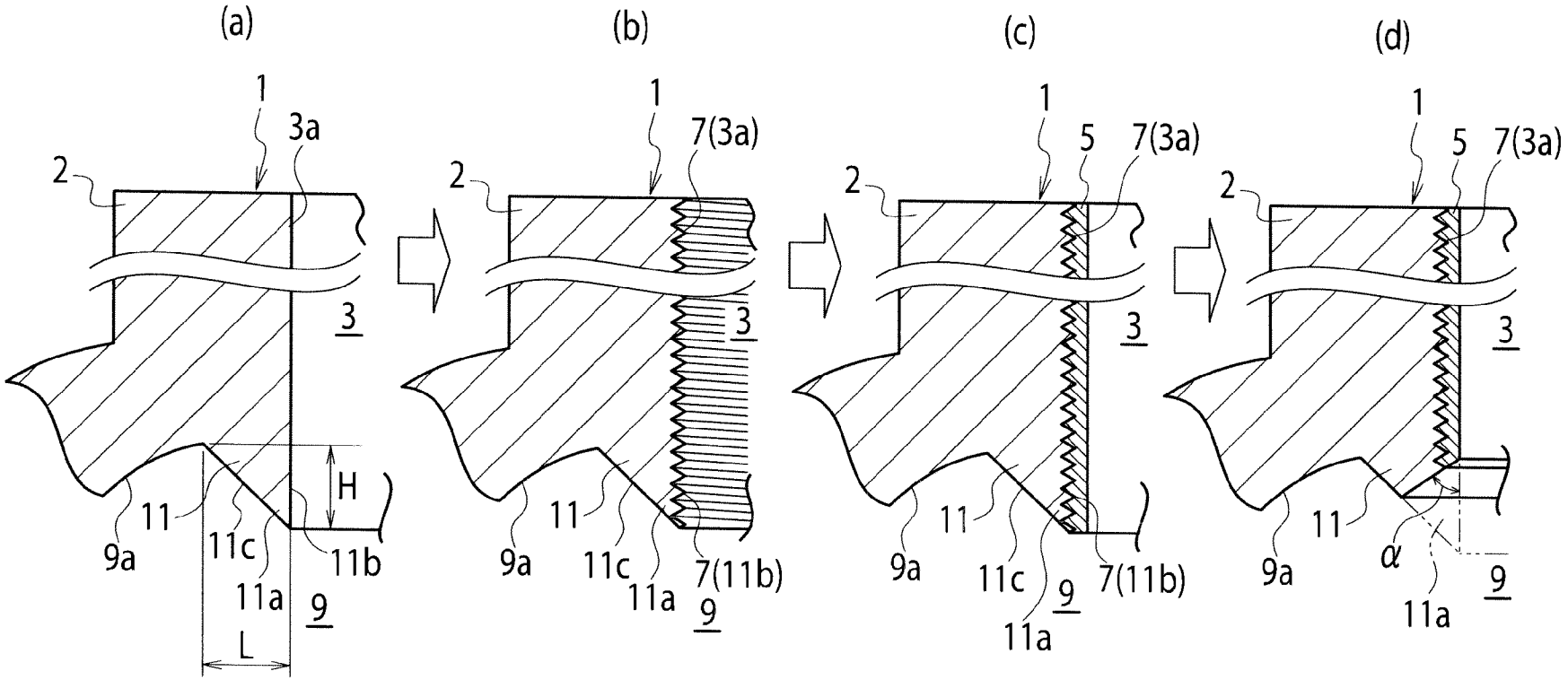
FIG. 2 is a production process view of the cylinder block shown in FIG. 1.

Next, a method for processing the cylinder block 1 shown in FIG. 1 will be explained with reference to FIG. 2. FIG. 2 shows only the left side of the cylinder 2 in FIG. 1. FIG. 2(*a*) shows the state after casting the cylinder block 1. As shown in FIG. 2(*a*), the protrusion 11 before removing the tip portion 11*a* is formed at the edge of the cylinder bore 3 and extends toward the crankcase 9.

The protrusion 11 before removing the tip portion 11*a* has an inner surface 11*b* that is continuous with the inner surface 3*a* of the cylinder bore 3 in the axial direction to define the edge portion of the cylinder bore 3. The protrusion 11 and the inner surface 11*b* are formed circularly.

On the opposite side of the inner surface 11*b* of the protrusion 11, an inclined surface 11*c* is formed. The inclined surface 11*c* is inclined in such a manner that the tip of the protrusion 11 is located closer to the center of the cylinder bore in the radial direction of the cylinder bore. The inclined surface 11*c* is also circumferentially formed around the periphery of the cylinder bore 3.

That is, the protrusion 11 has a maximum thickness L at the base portion in contact with the cylinder 2 or the crankcase 9 and becomes thinner toward the tip (on the lower edge side in FIG. 2(*a*)). As an example, the minimum value of the thickness L may be 4 mm, and the minimum value of a height H of the protrusion may be 1.3 mm+[the thickness of the sprayed coating after final processing/tan (chamfer angle)]. The chamfer angle corresponds to an angle α in FIG. 2(*d*).

Next, as shown in FIG. 2(*b*), the rough surface 7 is formed on the inner surface 3*a* of the cylinder bore 3 in FIG. 2(*a*) by base roughening processing. The rough surface 7 contributes to improved adhesion of the sprayed coating 5 formed later on the inner surface 3*a* of the cylinder bore 3.

Figure 3:
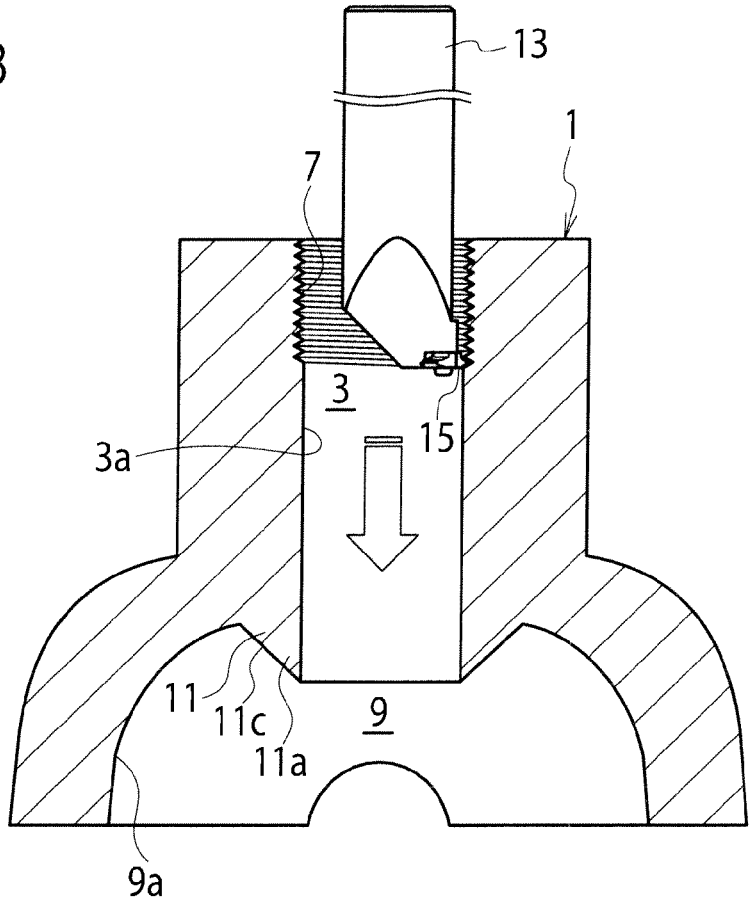
FIG. 3 is an operation explanatory view in surface roughening (b) in the production process shown in FIG. 2.

The base roughening processing may be performed by use of a boring processing machine as shown in FIG. 3. More specifically, a device with a tool (blade) 15 attached to the periphery of the tip of a boring bar 13 may be used. The boring bar 13 is moved downward in the axial direction while rotated so that the inner surface 3*a* of the cylinder bore 3 and the inner surface 11*b* of the protrusion 11 are formed into a screw hole shape. Accordingly, the corrugated rough surface 7 is formed on the inner surface 3*a* of the cylinder bore 3 and the inner surface 11*b* of the protrusion 11.

After the rough surface 7 is formed as described above, the sprayed coating 5 is sprayed on the inner surface 3*a* of the cylinder bore 3 and the inner surface 11*b* of the protrusion 11, as shown in FIG. 2(*c*). The sprayed coating 5 is uniformly formed on the inner surface 3*a* of the cylinder bore 3 and the inner surface 11*b* of the protrusion 11. The spraying method may be as described in Patent Document 1; however, the spraying method is not limited thereto.

After the sprayed coating 5 is provided as shown in FIG. 2(*c*), the tip portion 11*a* of the protrusion 11 provided as a processed and removable part is removed as shown in FIG. 2(*d*). The removal processing of the tip portion 11*a* may be carried out by a boring bar similar to that shown in FIG. 3 which is eccentrically rotated. However, the processing method is not particularly limited, and the processing can be carried out from the crankcase 9 side. After the removal of the tip portion 11*a*, the surface of the sprayed coating 5 is subjected to finishing process such as honing processing.

Next, the configuration of the protrusion 11 after removing the tip portion 11*a* will be explained with reference to FIG. 4 that is the enlarged view of the IV section in FIG. 1.

Figure 4:
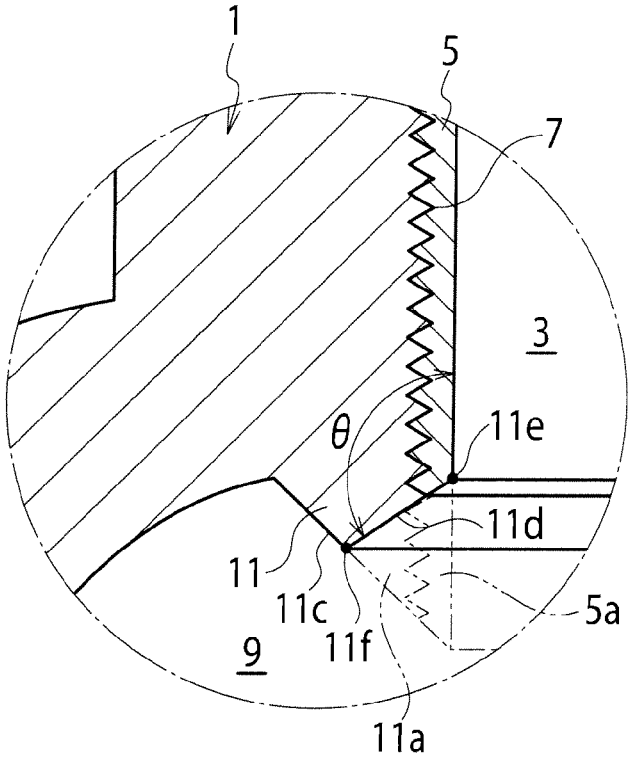
FIG. 4 is an enlarged cross-sectional view of the IV section shown in FIG. 1.

As shown in FIG. 4, an end surface 11*d* of the protrusion 11 provided after the tip portion 11*a* and part of the sprayed coating 5 are removed is inclined in such a manner that a cylinder bore inner surface end 11*e* is located on the opposite side of the crank case 9 in the axial direction of the cylinder bore 3 with respect to an opposite end 11*f* of the cylinder bore inner surface 3*a* in the radial direction. In other words, the end surface 11*d* in FIG. 4 is inclined in such a manner that the end portion 11*e* on the right side is located above the end portion 11*f* on the left side in the axial direction of the cylinder bore 3. The end surface 11*d* is formed along the circumference of the cylinder bore 3. Thus, the inner surface of the cylinder bore 3 (more accurately, the surface of the sprayed coating 5) makes an angle θ, which is an obtuse angle, with the end surface 11*d*. Note that, the end surface 11*d* may be horizontally provided without being inclined (perpendicular to the axis of the cylinder bore 3).

As described above, the sprayed coating 5 provided on the inner surface of the cylinder bore 3 has lower adhesion particularly at the edge portion of the cylinder bore 3 facing the crankcase 9 in the axial direction compared to the other area. In the present embodiment, the edge of the cylinder bore 3 is provided with the protrusion 11 toward the crankcase 9. In addition, the tip portion 11*a* that is part of the protrusion 11 is removed together with the low adhesion portion of the sprayed coating 5 so as to remove the base all together. Accordingly, the overall adhesion of the sprayed coating 5 on the cylinder bore 3 can be increased to provide a high-quality cylinder block 1.

In the present embodiment, the protrusion 11 protruding from the cylinder bore 3 toward the crankcase 9 is provided as a removal part. Namely, the protrusion 11 simply protrudes into the space of the crankcase 9. Therefore, the cylinder block 1 is prevented from increasing in size and further downsized even though the protrusion 11, which is to be removed, is provided. In addition, the protrusion 11 contributes to ensuring that a sufficient margin is provided for the removal operations.

Further in the present embodiment, the protrusion 11 has a tip portion that is thinner than the base portion so as to further decrease the volume of the protrusion 11 while increasing rigidity of the protrusion 11. Accordingly, the increased rigidity prevents deformation of the protrusion 11 at the time of the base roughening processing shown in FIG. 3. In addition, the protrusion 11 is downsized to a minimum to decrease the margin to be removed. Thus, the time that would be spent for removing the margin can be reduced and as a result, production costs can be decreased.

The decreased margin, which is to be removed, can prevent cavities from appearing on the surface of the material of the cylinder block 1 at the time of the casting process. Accordingly, the quality of the cylinder block 1 is improved.

According to the present embodiment, the end surface 11*d* of the protrusion 11 after removing the tip portion 11*a*, which is the removal margin, is inclined in such a manner that the cylinder bore inner surface end 11*e* is located on the opposite side of the crankcase 9 in the axial direction of the cylinder bore 3 with respect to the opposite end 11*f* of the inner surface 3*a*. As shown in FIG. 4, the inclined end surface 11*d* of the protrusion 11 is formed between the base of the cylinder bore 3 and the surface of the sprayed coating 5. Thus, the inner surface of the cylinder bore 3 (more accurately, the surface of the sprayed coating 5) makes an obtuse angle θ with the end surface 11*d* as shown in FIG. 4. Since the angle θ is an obtuse angle, the base on the cylinder block body side protrudes toward the crankcase 9 in the axial direction of the cylinder bore 3 with respect to the sprayed coating 5. Accordingly, the sprayed coating 5 adheres to the base more stably so as to prevent damage (detachment and cracking) of the sprayed coating 5.

The present embodiment includes the inclined surface 11*c*, which faces an inner wall 9*a* of the crankcase 9, provided on the protrusion 11 on the opposite side of the cylinder bore inner surface 3*a* after removing the tip portion 11*a*, which is the removal margin. Therefore, in the case in which an engine using the cylinder block 1 of the present embodiment is operated, rotation of a crank shaft (not shown in the figs.) causes oil to flow along the inner wall 9*a* and excessive amounts of the oil is prevented from entering the cylinder bore 3 by the inclined surface 11*c*. As a result, the amount of oil consumed in the cylinder bore 3 can be minimized. Accordingly, a user can reduce maintenance and operation costs, and the amount of oil contained in exhaust gas can be decreased to provide cleaner engine emissions.

In the present embodiment, the surface of the protrusion 11 facing the inner wall 9*a* is the inclined surface 11*c* inclined in such a manner that the tip of the protrusion 11 is located closer to the center of the cylinder bore in the radial direction. Therefore, during engine operation, the oil flows downward more smoothly and thus, the oil is prevented from entering the cylinder bore 3 more reliably.

According to the present embodiment, the tip portion 11*a* is removed as part of the protrusion 11; however, the entire protrusion 11 may be removed. In each case, the end surface provided after the removal is preferably inclined as the end surface 11*d* shown in FIG. 4.

Although the protrusion 11 has a tip portion that is thinner than the base portion, the thickness of the protrusion 11 may be uniform as a whole. In such a case, the inclined surface 11*c* shown in FIG. 2(*a*) is provided as an inner wall facing surface that is parallel to the axial direction of the cylinder bore 3. Even if the inner wall facing surface is parallel to the axial direction, the oil flowing along the inner wall 9*a* can be prevented from entering the cylinder bore excessively.

The entire content of Japanese Patent Application No. P2010-054403 (filed on Mar. 11, 2010) is herein incorporated by reference.

Although the present invention has been described above by reference to the embodiment, the present invention is not limited to the description thereof, and it will be apparent to these skilled in the art that various modifications and improvements can be made within the scope of the present invention.

INDUSTRIAL APPLICABILITY

According to the present invention, the part to be removed provided at the edge of the cylinder bore on the crankcase side protrudes from the inner surface of the cylinder bore toward the crankcase to prevent detachment of the coating. Accordingly, in the case of removing the edge portion on the crankcase side together with the sprayed coating, a sufficient margin to be removed can be ensured while a reduction in size of the cylinder block is achieved.

REFERENCE SIGNS LIST

1 Cylinder block
2 Cylinder bore
3*a* Inner surface of cylinder bore
5 Sprayed coating
5*a* Sprayed coating at edge portion of protrusion
9 Crankcase
9*a* Inner wall of crankcase
11 Protrusion
11*a* Tip portion of protrusion (part of protrusion)
11*b* Inner surface of protrusion
11*c* Inclined surface on opposite side of inner surface of protrusion (inner wall facing surface)
11*d* End surface of protrusion after tip portion removal

The invention claimed is:

1. A method for processing a cylinder block, comprising:
providing a protrusion protruding into a space toward a crankcase at a crankcase-side edge of a cylinder bore;
forming a sprayed coating on an inner surface of the cylinder bore and an inner surface of the protrusion continuous with the inner surface of the cylinder bore; and
after forming the sprayed coating, removing at least part of the protrusion together with the sprayed coating formed on the inner surface of the protrusion.

2. The method for processing a cylinder block according to claim 1,
wherein the protrusion has a tip portion that is thinner than a base portion.

3. The method for processing a cylinder block according to claim 1,
wherein an end surface of the protrusion provided after removing the at least part of the protrusion is inclined such that a cylinder bore inner surface end is located on an opposite side of the crankcase in an axial direction of the cylinder bore with respect to an opposite end of the inner surface of the cylinder bore.

4. The method for processing a cylinder block according to claim 3,
wherein the inclined end surface of the protrusion is formed between a base of the cylinder bore and the sprayed coating.

5. The method for processing a cylinder block according to claim 1,
wherein an inner wall facing surface that faces an inner wall of the crankcase is provided at the protrusion on an opposite side of the inner surface of the cylinder bore after removing the at least part of the protrusion.

6. The method for processing a cylinder block according to claim 5,
wherein the inner wall facing surface of the protrusion is inclined in such a manner that a tip of the protrusion is located closer to a center of the cylinder bore in a radial direction of the cylinder bore.

7. A cylinder block, comprising:
a cylinder;
a protrusion provided at a crankcase-side edge of a cylinder bore of the cylinder and protruding into a space toward a crankcase; and
a sprayed coating formed on an inner surface of the cylinder bore and an inner surface of the protrusion continuous with the inner surface of the cylinder bore,
wherein at least part of the protrusion is removed together with the sprayed coating formed on the inner surface of the protrusion.

8. The cylinder block according to claim 7,
wherein the protrusion has a tip portion that is thinner than a base portion.

9. The cylinder block according to claim 7,
wherein an end surface of the protrusion provided after removing the at least part of the protrusion is inclined such that a cylinder bore inner surface end is located on an opposite side of the crankcase in an axial direction of the cylinder bore with respect to an opposite end of the inner surface of the cylinder bore.

10. The cylinder block according to claim 9,
wherein the inclined end surface of the protrusion is formed between a base of the cylinder bore and the sprayed coating.

11. The cylinder block according to claim 7, wherein an inner wall facing surface that faces an inner wall of the crankcase is provided at the protrusion on an opposite side of the inner surface of the cylinder bore after removing the at least part of the protrusion.

12. The cylinder block according to claim 11, wherein the inner wall facing surface of the protrusion is inclined such that a tip of the protrusion is located closer to a center of the cylinder bore in a radial direction of the cylinder bore.

13. A thermal-sprayed cylinder block provided with a sprayed coating formed on an inner surface of a cylinder bore, the cylinder block comprising:

a cylinder; and a protrusion provided at a crankcase-side edge of the cylinder bore of the cylinder and protruding into a space toward a crankcase, wherein, after forming the sprayed coating on an inner surface of the protrusion, at least part of the protrusion is removed together with the sprayed coating, and wherein the inner surface of the protrusion is continuous with the inner surface of the cylinder bore in an axial direction of the cylinder bore.

* * * * *